United States Patent [19]

Smith

[11] Patent Number: 4,647,898

[45] Date of Patent: Mar. 3, 1987

[54] ELECTRONIC DEVICE WITH IMPROVED ELEMENT RETENTION

[75] Inventor: Ronald E. Smith, Sunnymead, Calif.

[73] Assignee: Bourns, Inc., Riverside, Calif.

[21] Appl. No.: 734,015

[22] Filed: May 13, 1985

[51] Int. Cl.[4] ..... H01C 10/48

[52] U.S. Cl. ..... 338/192; 338/149; 338/184

[58] Field of Search ..... 338/193, 136, 192, 184, 338/199, 164, 161, 174, 132, 149, 197

[56] References Cited

U.S. PATENT DOCUMENTS

| | | | |
|---|---|---|---|
| 2,476,294 | 7/1949 | Hampton | 201/56 |
| 2,480,995 | 9/1949 | Armitage | 201/56 |
| 3,593,252 | 7/1971 | Shiro et al. | 338/132 |
| 3,629,777 | 12/1971 | DeLong et al. | 338/184 X |
| 3,750,079 | 7/1973 | Scheiterbauer et al. | 338/164 |
| 3,760,324 | 9/1973 | Baldwin et al. | 338/174 |

*Primary Examiner*—E. A. Goldberg
*Assistant Examiner*—M. M. Lateef
*Attorney, Agent, or Firm*—Howard J. Klein; William G. Becker

[57] ABSTRACT

A retention mechanism for retaining an electrical element securely within a housing is specifically adapted for use with a loop-shaped (e.g., substantially annular) electrical element, having two ends separated by a small gap. The mechanism comprises a gap-registrable member in the housing cavity containing the electrical element, whereby the gap-registrable member registers with, and fits into the gap of the electrical element when the latter is seated on a seating surface in the cavity. The gap-registrable member is dimensioned to spread the gap, thereby radially expanding the electrical element to bring it into a locking frictional engagement against the walls of the cavity. The gap-registrable element advantageously serves also as a stop for a rotational contact, or wiper, included with the electronic device. The side wall of the cavity is advantageously provided with a radially-inwardly extending lip that is engageable with the electrical element to restrain it from lifting off of the seating surface.

15 Claims, 7 Drawing Figures

ELECTRONIC DEVICE WITH IMPROVED ELEMENT RETENTION

BACKGROUND OF THE INVENTION

This invention relates generally to the field of electronic devices. More specifically, it relates to a housing for a miniature electronic device, such as a potentiometer, wherein the housing includes means for mechanically retaining an electrical element therein without the need for thermal or adhesive bonding.

Many electronic devices, both miniature and subminiature, include a wirewound electrical element. Usually, the wirewound element functions as the resistive element in a potentiometric device. Typically, the wirewound element in a miniature potentiometer, for example, is secured to a seating surface enclosed within a housing. The element is retained in place on the seating surface by one of two methods. One method employs an epoxy preform placed on the surface and heat-cured to form an adhesive bond with the element. The other method requires the use of a thermoplastic composition for the seating surface, the thermoplastic being heat-softened to allow the element to sink partway into the seating surface. The heat required by both of these methods is usually applied by passing a relatively high electric current through the electrical element, a process sometimes referred to as "zapping" the element.

The above-described methods of retaining the element by either adhesive or thermal bonding add to the complexity of manufacturing the devices, and therefore, increase their cost. Also, the "zapping" of the element must be carefully controlled to avoid damage to the element.

To avoid the problems associated with thermal and adhesive bonding, purely mechanical retention means have been devised in various configurations. For example, wedging members have been employed, as shown in U.S. Pat. No. 2,476,294 to Hampton and U.S. Pat. No. 2,480,995 to Armitage. To date, however, such mechanical retention means have not been well-received for miniature devices, due to the relative difficulty of manufacturing the required mechanical structures on a physically-reduced scale.

Accordingly, it can be seen that there is a long-felt and yet unfilled need in the electronic device art for a purely mechanical means for element retention that is well-suited for miniaturization.

SUMMARY OF THE INVENTION

Broadly, the present invention is a mechanism for retaining an electrical element in a housing, whereby the cavity or chamber in which the element is seated includes means for expanding or spreading the element to bring it into a firm frictional engagement with the interior wall surfaces defining the cavity.

More specifically, the present invention contemplates a loop-shaped (e.g., substantially annular) electrical element having two ends separated by a small gap. The interior of the cavity is provided with a member extending from the seating surface which registers with, and fits into the gap when the element is seated on the seating surface. The member is somewhat wider than the gap in the element, so that the element is spread or expanded radially to bring it into firm, locking, frictional engagement against the wall surfaces of the cavity. Advantageously, where the invention is employed in a device, such as a potentiometer, having a rotational contact ("wiper"), the gap-registrable member also serves as a stop for blocking the rotation of the wiper past the ends of the electrical element.

An inwardly-extending lip is advantageously provided on the wall surface of the cavity at a location circumferentially displaced from the gap-registrable member. The lip is engageable with a portion of the electrical element to restrain the element from lifting off of the seating surface.

The arrangement described above provides good element retention by purely mechanical means, thereby eliminating adhesive or thermal bonding. Moreover, the mechanical structure involved is simple and easily adapted to miniaturization. Thus, for example, the gap-registrable member that expands the electrical element is provided merely by modifying the stop element that already exists in many miniature wirewound potentiometers. The aforementioned lip can be provided by a simple slot or undercut made in the side wall of the cavity containing the electrical element. Therefore, ease of manufacture and attendant low costs are achieved by the present invention.

These and other advantages will be better appreciated from the detailed description which follows.

DETAILED DESCRIPTION OF A PREFERRED EMBODIMENT

Figure 1:
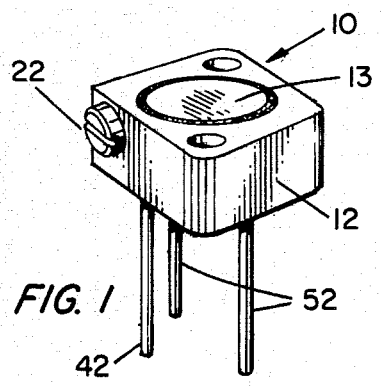
FIG. 1 is a perspective view of a worm screw-actuated potentiometer of a type in which the present invention can be embodied.
Figure 2:
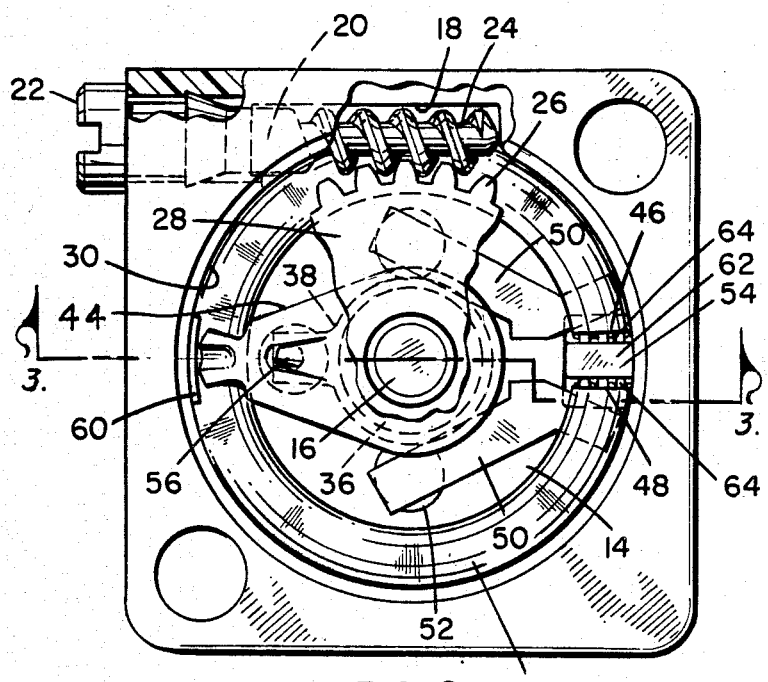
FIG. 2 is a top plan view of the potentiometer of FIG. 1, partially broken away to show the internal components thereof.
Figure 3:
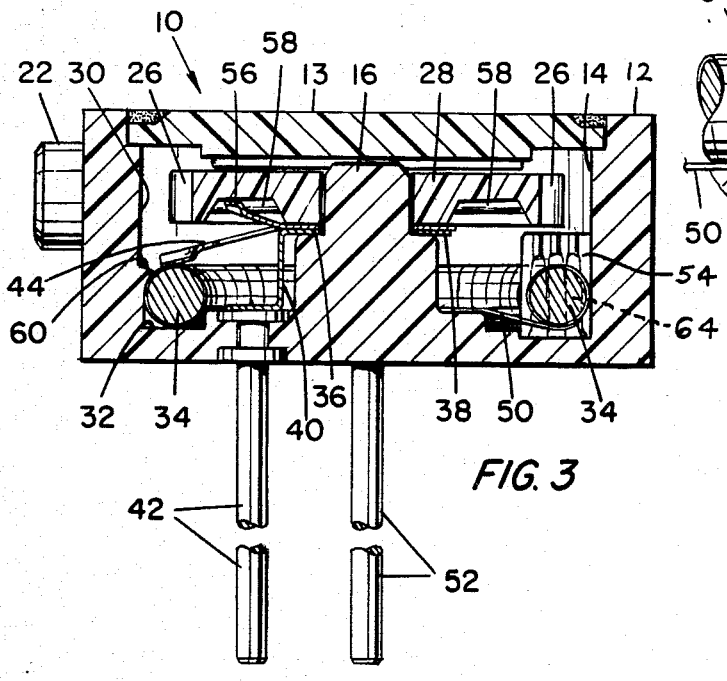
FIG. 3 is a cross-sectional view along line 3—3 of FIG. 2.

Referring first to FIGS. 1, 2, and 3, a worm screw-actuated potentiometer 10 is illustrated, constructed in accordance with a preferred embodiment of the present invention. It should be noted at the outset that the potentiometer 10 is, by way of example only, the present invention being fully adaptable for use in a variety of electronic devices incorporating wirewound elements and the like.

The potentiometer 10 is generally of a type well-known in the art, comprising a housing 12, with a lid or cover 13. The interior of the housing 12 has a generally annular chamber 14 surrounding a central hub or post 16. Accommodated in an elongate bore 18 in the housing is a worm screw 20 having an exposed slotted head 22 and an elongate worm gear portion 24. The bore 18 is offset to one side of the chamber 14, but is contiguous therewith, so that the worm gear 24 can engage the spur gear teeth 26 provided on a discoid rotor 28. The rotor 28, in turn, is supported for rotation on the post 16.

The chamber 14 is defined by a substantially annular sidewall 30 surrounding a substantially annular seating surface 32 (FIG. 3), on which is seated a wirewound resistive element 34. The resistive element 34 is of conventional construction, comprising a continuous length of wire helically wrapped onto a mandrel, and formed into a substantially circular or annular configuration. As will be described below in detail, the present invention concerns the mechanism by which the wirewound element 34 is held in place.

Continuing with the general description of the potentiometer 10, the post 16 has a stepped shoulder 36 on which is carried a conductive collector ring 38. The collector ring 38 is fixed in place, having an extension or tab 40 (FIG. 3) which is electrically connected to the interior end of a collector lead 42 that extends through the bottom of the housing.

A spring contact or wiper 44 is mounted on the post 16 between the underside of the rotor 28 and the collector ring 38. The wiper 44 rotates with the rotor 28 as the rotor is turned by the engagement between the worm gear 24 and the spur gear teeth 26. Thus, the wiper 44 wipes around the circumference of the wirewound element 34, with an electrical path being established between the wiper 44 and the collector lead 42 via the collector ring 38 and the tab 40.

As will be described more fully below, the wirewound element 34 has a pair of opposed ends 46 and 48 separated by a gap. Each of the ends 46 and 48 is contacted by an end of one of a pair of conductive strips 50. The other end of each of the strips 50 is electrically connected to the interior end of one of a pair of terminal leads 52. Thus, an electrical path is established between each end of the wirewound element 34 and an individual terminal lead 52 via one of the conductive strips 50.

Extending upwardly from the seating surface 32 and radially inwardly from the chamber wall 30 is a stop element 54. The stop element 54 is located so as to be registrable with the aforementioned gap between the ends 46 and 48 of the wirewound element 34 when the latter is installed, as will be described in further detail below. The upward extension of the stop element 54 is such that the wiper 44 abuts against it at each limit of travel of its rotational path between the ends 46 and 48 of the wirewound element 34. When the abutment between the wiper 44 and the stop element 54 occurs at the limits of travel, a ratchet mechanism allows the rotor 28 to continue to turn while allowing the wiper 44 to slip, thereby preventing damage to the wiper due to overdriving the rotor. This ratcheting mechanism comprises an upwardly extending prong 56 on the wiper 44 and an array of radially-extending ratchet teeth 58 on the underside of the rotor 28, as best shown in FIG. 3. When the rotor turns between the limits of travel, the prong 56, carried between a pair of adjacent ratchet teeth 58, causes the wiper 44 to turn with the rotor. When a limit of travel is reached, the wiper 44 is restrained from further rotation by its abutment against the stop element 54. Continued rotation of the rotor 28 causes the prong 56 to slip its engagement in the ratchet teeth 58 of the rotor, thereby preventing damage to the wiper from being driven into the stop element. When rotation of the rotor is reversed, the prong is again carried between a pair of ratchet teeth, causing the wiper likewise to rotate in the reverse direction.

As previously mentioned, the present invention centers on the mechanism that retains the wirewound element 34 in place on the seating surface 32. One component of this retention mechanism is a lip 60 extending radially inwardly from the interior wall surface 30 along a portion of the wall surface circumferentially displaced from the stop element 54. In the preferred embodiment shown in the drawings, a single lip 60 is located diametrically opposite the stop element 54, although other arrangements may be suitable. The lip 60 is located with respect to the seating surface 32 so as to be engageable with an arcuate segment of the wirewound element 34, engaging the element slightly over its top, but not within the rotational path of the wiper 44, as best shown in FIG. 3.

Figure 6:
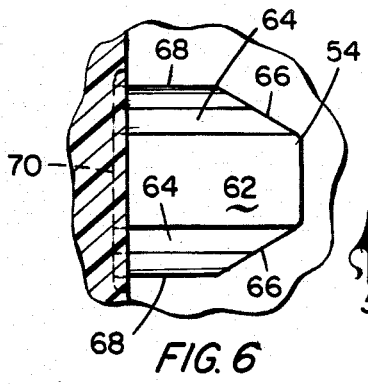
FIG. 6 is an elevational view taken from the free (radially interior) end of the interference nub of FIG. 4.
Figure 4:
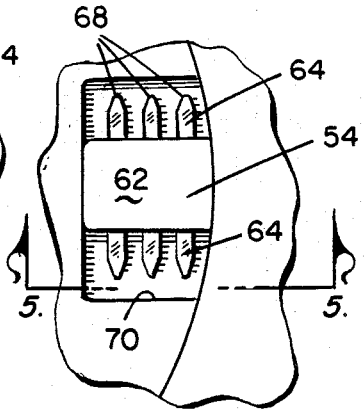
FIG. 4 is a detailed top plan view of the interference nub used in a preferred embodiment of the present invention, prior to installation of the resistive element.
Figure 5:
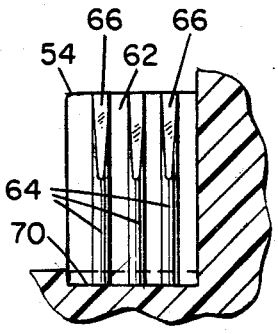
FIG. 5 is a view along line 5—5 of FIG. 4.
Figure 7:
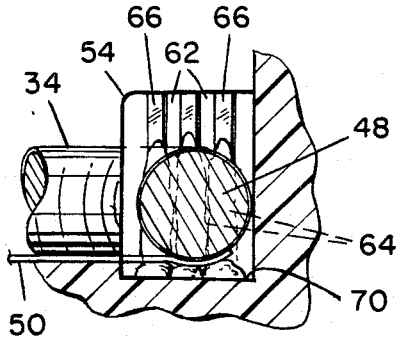
FIG. 7 is a view similar to that of FIG. 5, but showing the resistive element installed.

The other major component of the retention mechanism is the stop element 54. As illustrated in FIGS. 4, 5, and 6, the stop element 54 comprises, initially (before installation of the wirewound element 34), a substantially solid central block 62 which stops the rotation of the rotor 28, as previously described. A plurality of tooth-like interference nubs 64 extends from each side of the block 62. The nubs 64, formed of a deformable material, such as plastic, have sloped upper edges 66 and tapered ends 68. As previously mentioned, the stop element 54 is located so as to be registrable with the gap between the wirewound element ends 46 and 48 when the wirewound element 34 is installed onto the seating surface 32. The stop element 54, with its nubs 64, is somewhat wider than the gap, so that when the stop element is inserted into the gap, the sloped upper edges 66 of the nubs 64 cause the gap to spread, while the tapered ends 68 of the nubs 64 frictionally engage the ends 46 and 48 of the wirewound element. As shown in FIG. 7, the frictional engagement of the element ends 46 and 48 with the nubs 64 causes the nubs to deform, either by mashing or shearing, or both, thereby assuring that a secure interference engagement between the nubs 64 and the element ends 46 and 48 is maintained. A depression or undercut 70 is provided in the area of the seating surface 32 around the stop element 54. This depression 70 underlies the wirewound element, and serves as a receptacle for abraded-off fragments 72 of the nubs 64, collecting these fragments underneath the wirewound element as shown in FIG. 7, so they will not interfere with the electrical contact between the wiper 44 and the wirewound element.

The aforementioned spreading of the wirewound element gap by the nubs 64 causes a radially-outward displacement or expansion of the wirewound element, bringing it into a tight interference engagement against the interior wall surface 30 of the chamber 14. The interference fit between the element 34 and the adjacent wall surface 30 retains the element firmly in place in the chamber, on or closely adjacent to the seating surface 32. The lip 60 is advantageous in that it retains the wirewound element 34 from lifting any appreciable amount off of the seating surface 32. In some applications, however, the frictional engagement between the wirewound element 34 and the wall surface 30 may be sufficient, by itself, to keep the element properly located and restrained from movement. In such cases, it may be possible either to omit the lip 60, or to employ it as a redundant restraint and as a means for applying leverage when the stop element 54 is squeezed into the gap in the wirewound element. Specifically, installation of the wirewound element can be accomplished simply by aligning the gap with the stop element, slipping the wirewound element under the lip 60, and pushing the ends 46 and 48 down over the nubs 64 while the lip 60 provides vertical retention and leverage.

From the foregoing, it can be appreciated that the retention of the wirewound element in the chamber is accomplished purely by the engagement between the wirewound element and the nubs 64, the interior wall surface 30, and the lip 60. This engagement also restrains the element from movement within the chamber, either axially or rotationally. This retention/restraint function is accomplished by purely mechanical means, without the need for thermal or adhesive bonding. Moreover, the mechanical retention function is accomplished with a structure that is well-adapted to both miniaturization and low-cost mass production. Thus, for example, the present invention requires only a modification of the molded stop element that already exists in many miniature potentiometers, while the lift-restraining lip can be provided by a simple slot or undercut in the side wall of the element-containing chamber of the device.

While a preferred embodiment of the invention has been described above, various modifications and variations will suggest themselves to those skilled in the pertinent arts. First, it should be emphasized that the present invention may be adapted for use with various electrical elements, other than wirewound elements, that are formed and installed as separate, discrete elements in the electronic device. Second, it should be noted that the configurations of the interference nubs 64 and the lip 60, as described above, are exemplary only; various modifications may be employed depending upon the needs of a particular application. These and other modifications should be considered within the spirit and scope of the invention, as defined in the claims which follow.

What is claimed is:

1. An electronic device of the type including a housing having an interior seating surface surrounded by an interior wall surface, an electrical element in the configuration of a nearly-closed loop seated on said seating surface and having first and second ends separated by a gap, and a rotatable contact conductively engageable with said electrical element, wherein the improvement comprises:

first means, on said interior wall surface, and engageable with said electrical element, for restraining the lifting of said electrical element from said seating surface; and second means, located adjacent said seating surface so as to be registrable with said gap when said electrical element is seated on said seating surface, said second means being dimensioned so that the registration of second means with said gap effects a spreading of said gap and a radially-outward displacement of said electrical element against said interior wall surface;

whereby said electrical element is retained in said housing by the engagement between said electrical element and said first means, and by the engagement of said electrical element and said interior wall surface.

2. The electronic device of claim 1, wherein said electrical element is a wirewound element substantially annular in configuration.

3. The electronic device of claim 1, wherein said interior wall surface is substantially annular, and wherein said first means comprises a radially-inwardly extending lip circumferentially displaced along said wall surface from said second means.

4. The electronic device of claim 1, wherein said second means is located in the rotational path of said rotatable contact and includes means for blocking the rotation of said rotatable contact past said first and second ends of said electrical element.

5. The electronic device of claim 1, wherein said second means includes a deformable member that deforms upon engagement with said electrical element and thereby effects an interference engagement therewith.

6. An electronic device comprising:

a housing having an interior chamber defined by a substantially annular seating surface surrounded by a substantially annular wall surface;

a substantially annular wirewound element seated on said seating surface, said electrical element having first and second ends separated by a gap;

a rotatable electrical contact conductively engageable with said electrical element;

a pair of fixed electrical contacts conductively connected to said electrical element;

first means on said interior wall surface, and engageable with an arcuate segment of said electrical element for restraining the lifting of said electrical element from said seating surface; and second means extending upwardly from said seating surface, and located so as to be registrable with said gap when said electrical element is seated on said seating surface, said second means being dimensioned so that the registration of said second means with said gap effects a radially-outward displacement of said electrical element against said interior wall surface;

whereby said electrical element is retained in said housing by the engagement between said electrical element and said first means, and by the engagement between said electrical element and said wall surface.

7. The electronic device of claim 6, wherein said electrical element is a wirewound element.

8. The electronic device of claim 6, wherein said first means comprises a lip extending radially inwardly from said wall surface and circumferentially displaced along said wall surface from said second means.

9. The electronic device of claim 6, wherein said second means is located in the rotational path of said rotatable contact so as to block the rotation of said rotatable contact past said first and second ends of said electrical element.

10. The electronic device of claim 6, wherein said second means includes a deformable member that deforms upon registration with said gap and engagement with said first and second ends of said electrical element to effect an interference engagement with said first and second ends.

11. An electronic device, of the type including a housing having an interior chamber defined by a substantially annular seating surface surrounded by a substantially annular wall surface, a substantially annular electrical element seated on said seating surface and having first and second ends separated by a gap, and a rotatable contact conductively engageable with said electrical element along a rotational path between said first and second ends, wherein the improvement comprises:

blocking means, located in said chamber so as to fit into said gap when said electrical element is seated on said seating surface, and further located in the rotational path of said rotatable contact, for blocking the rotation of said rotatable contact past said first and second ends of said electrical element;

whereby said blocking means is dimensioned so that said first and second ends of said electrical element are spread apart sufficiently to bring said electrical element into engagement against said wall surface.

12. The electronic device of claim 11, wherein said electrical element is a wirewound element.

13. The electronic device of claim 11, further comprising:

restraining means on said wall surface, circumferentially displaced from said blocking means, and engageable with a portion of said electrical element, for restraining the lifting of said electrical element from said seating surface.

14. The electronic device of claim 13, wherein said restraining means comprises a lip extending radially inwardly from said wall surface.

15. The electronic device of claim 11, wherein said blocking means comprises:

a substantially solid central element; and deformable means, extending from the sides of said central element so as to be engageable with said first and second ends when said blocking means is inserted into said gap, for effecting an interference engagement with said first and second ends.

* * * * *